US008422903B2

(12) United States Patent
Maeda

(10) Patent No.: US 8,422,903 B2
(45) Date of Patent: Apr. 16, 2013

(54) IMAGE FORMING APPARATUS AND IMAGE FORMING METHOD

(75) Inventor: Katsuhiko Maeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1037 days.

(21) Appl. No.: 12/107,387

(22) Filed: Apr. 22, 2008

(65) Prior Publication Data

US 2008/0273902 A1 Nov. 6, 2008

(30) Foreign Application Priority Data

May 1, 2007 (JP) ..... 2007-121146
Mar. 18, 2008 (JP) ..... 2008-068985

(51) Int. Cl.
*G03G 15/00* (2006.01)
*G03G 15/01* (2006.01)

(52) U.S. Cl.
USPC ..... 399/72; 399/301

(58) Field of Classification Search ..... 399/301
See application file for complete search history.

(56) References Cited

U.S. PATENT DOCUMENTS 5,768,671 A * 6/1998 Komiya et al. ..... 399/301
6,137,518 A 10/2000 Maeda
6,249,304 B1 6/2001 Sawayama et al.
6,292,206 B1 9/2001 Takehara et al.
7,313,352 B2 12/2007 Shinohara et al.
2007/0217831 A1 9/2007 Maeda
2008/0084571 A1 4/2008 Maeda
2008/0292335 A1* 11/2008 Kubota et al. ..... 399/39

FOREIGN PATENT DOCUMENTS

JP 63-43172 2/1988
JP 64-6981 1/1989
JP 01118864 A * 5/1989
JP 8-22160 1/1996
JP 9-277609 10/1997
JP 2002-131667 5/2002
JP 2003291424 A * 10/2003
JP 2004-295083 10/2004

OTHER PUBLICATIONS

Office Action issued Jun. 12, 2012 in Japanese Patent Application No. 2008-068985.

* cited by examiner

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

A pattern forming unit forms a pattern for correcting a position shift of an image. A detecting unit detects the pattern. A measuring unit measures a time from a start of a control signal for controlling timing to start forming the image until a detection of the pattern. A control unit controls a position of forming the image based on the time measured by the measuring unit.

12 Claims, 17 Drawing Sheets

IMAGE FORMING APPARATUS AND IMAGE FORMING METHOD

CROSS-REFERENCE TO RELATED APPLICATIONS

The present application claims priority to and incorporates by reference the entire contents of Japanese priority documents, 2007-121146 filed in Japan on May 1, 2007 and 2008-068985 filed in Japan on Mar. 18, 2008.

BACKGROUND OF THE INVENTION

1. Field of the Invention

The present invention relates to a technology for correcting color misalignment of an image in an image forming apparatus.

2. Description of the Related Art

A color image forming apparatus forms a full color image by superimposing images in different colors. If positions of the images in different colors are shifted from the preset position, an obtained image such as a line image or a text image is not in a desired color or experiences a color drifting or a color shading, resulting in degradation of image quality. Therefore, it is necessary to adjust the positions of the images in different colors upon forming an image in the color image forming apparatus. A conventional technology for correcting a position shift between images in different colors caused by change in an ambient temperature, an device-internal temperature, or the like in the image forming apparatus having a plurality of photosensitive elements is disclosed in, for example, Japanese Patent Application Laid-Open No. 2004-295083.

In the above conventional technology, a position-shift correction pattern for each color is formed on a transfer belt, and a plurality of sensors are configured to detect the patterns. Then, the amount of shift, such as a magnification error in the main-scanning direction and a registration error in the main-scanning direction and in the sub-scanning direction, is detected based on a signal from the sensor to correct the shift. With the detection of the above parameters, not only a position shift caused by the environmental change but also a position shift caused by temporal change can be corrected. As a result, an image in desired quality can be formed without color shift.

In the conventional technology, the position shift caused by the environmental change and the position shift caused by temporal change are corrected by detecting amounts of position shift of images in other colors with respect to a position of an image in a reference color. However, there is a possibility that the position of the image in the reference color is also shifted due to the environmental change and the temporal change, shifting the reference position for the images in other colors. For example, even if the reference position is adjusted at the time of shipping from a factory, the reference position may change after delivery, or the reference position may be shifted from a position for the first image forming after forming a plurality of images. The same goes even for an image forming apparatus that forms a monochrome (black-and-white) image.

When forming the position-shift correction patterns for respective colors to correct the position shift between images during a continuous printing, it is necessary to form the patterns within a predetermined time (distance). In some cases, the patterns for all colors may not be formed because the predetermined time is limited. However, it is not preferable to lengthen the time (distance) considering an overall printing speed.

SUMMARY OF THE INVENTION

It is an object of the present invention to at least partially solve the problems in the conventional technology.

According to an aspect of the present invention, there is provided an image forming apparatus including a pattern forming unit that forms a pattern for correcting a position shift of an image; a detecting unit that detects the pattern; a measuring unit that measures a time from a start of a control signal for controlling timing to start forming the image until a detection of the pattern; and a control unit that controls a position of forming the image based on the time measured by the measuring unit.

Furthermore, according to another aspect of the present invention, there is provided an image forming method including forming a pattern for correcting a position shift of an image; detecting the pattern; measuring a time from a start of a control signal for controlling timing to start forming the image until a detection of the pattern; and controlling a position of forming the image based on the time measured at the measuring.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
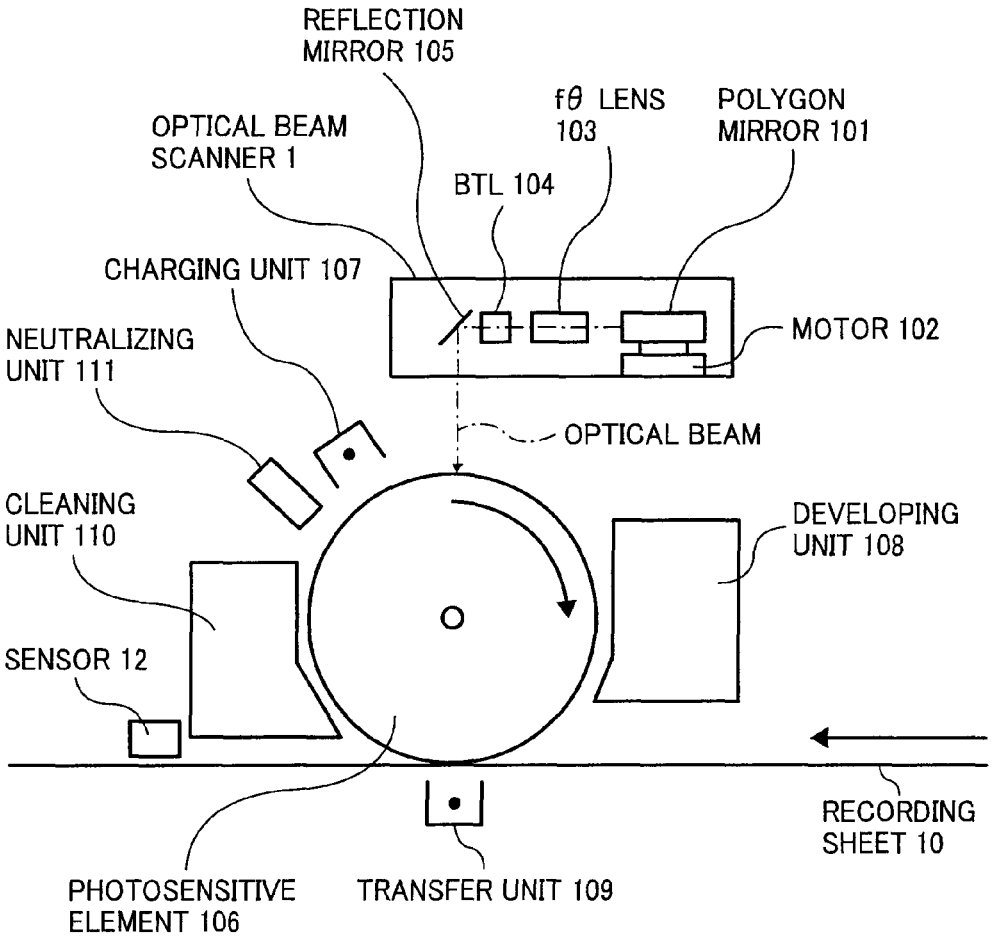
FIG. 1 is a schematic diagram of main constituent elements of an image forming apparatus according to a first embodiment of the present invention.

FIG. 1 is a schematic diagram of main constituent elements of an image forming apparatus according to a first embodiment of the present invention. An optical beam scanner (optical unit) 1 configured as an optical unit includes a laser diode (LD) to be turned ON based on image data, a collimating lens (not shown) that collimates a laser beam (hereinafter, referred to as "optical beam" as appropriate) emitted from the LD, a cylindrical lens (not shown) that focuses the laser beam on a line parallel to the sub scanning direction, a polygon mirror 101 that deflects an incident light from the cylindrical lens, a motor 102 that rotates the polygon mirror 101 at a predetermined speed, an fθ lens 103 that converts a constant angular-velocity scanning of the optical beam deflected by the polygon mirror 101 into a constant line-velocity scanning, a barrel toroidal lens (BTL) 104, and a deflection mirror 105. With this configuration, an optical beam emitted from the LD is collimated by the collimating lens (not shown), focused by the cylindrical lens (not shown), and deflected by the polygon mirror 101, passes through the fθ lens 103 and the BTL 104, is deflected by the deflection mirror 105, to perform a scanning of the surface of a photosensitive element 106. The BTL 104 has a function of performing a focusing in the sub-scanning direction (light focusing function and shift correction (optical tangle error correction) function in the sub-scanning direction).

A charging unit 107, a developing unit 108, a transferring unit 109, a cleaning unit 110, and a neutralizing unit 111 are arranged around the photosensitive element 106, forming an imaging unit. An electrophotographic process including processes of charging, exposing, developing, and transferring is performed to form an image on a recording sheet P, and the image is fixed on the recording sheet P by a fixing unit (not shown).

A sensor 12 that detects a pattern formed on a transfer belt 10 for correcting an image shift (hereinafter, "shift correction pattern") is provided. The sensor 12 is a reflection-type optical sensor arranged to face the transfer belt 10 to detect the position-shift correction pattern formed on the transfer belt 10. A printer control unit 201 corrects a position of the image in the sub-scanning direction based on a result of detecting the position-shift correction pattern.

Figure 2:
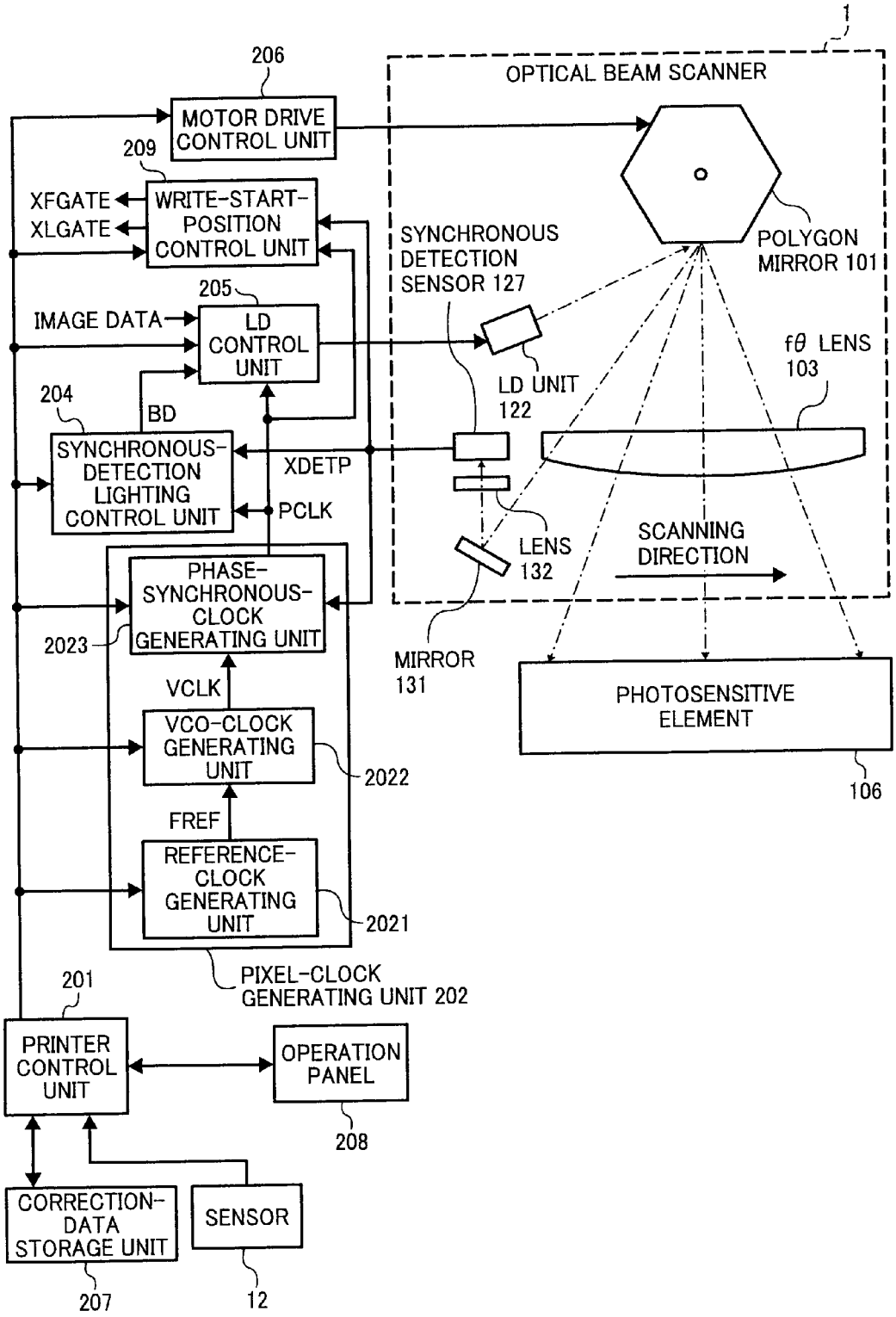
FIG. 2 is a schematic diagram of an image-forming control unit of the image forming apparatus shown in FIG. 1.

FIG. 2 is a schematic diagram of an image-forming control unit of the image forming apparatus shown in FIG. 1 and the optical beam scanner 1. A control system shown in FIG. 2 includes the printer control unit 201, a pixel-clock generating unit 202, a synchronous-detection lighting control unit 204, an LD control unit 205, a motor drive control unit 206, and a write-start-position control unit 209. The printer control unit 201 is used for a plurality of colors while the other units are provided for each color. The pixel-clock generating unit 202 includes a reference-clock generating unit 2021, a voltage-controlled oscillator (VCO)-clock generating unit 2022, and a phase-synchronous-clock generating unit 2023. A synchronous detection sensor 127 that detects an optical beam is arranged on the end portion in the main-scanning direction of the optical beam scanner 1 where the image is to be output. The optical beam passes through the fθ lens 103 is reflected by a mirror 131, and condensed onto the synchronous detection sensor 127 by a lens 132. The write-start-position control unit 209 receives a start-side synchronous detection signal XDETP from the synchronous detection sensor 127 and a pixel clock PCLK from the pixel-clock generating unit 202.

The optical beam passes through the synchronous detection sensor 127 in the optical beam scanner 1, thereby the synchronous detection sensor 127 outputs the synchronous detection signal XDETP to the pixel-clock generating unit 202, the synchronous-detection lighting control unit 204, and the write-start-position control unit 209. The pixel-clock generating unit 202 generates the pixel clock PCLK synchronized with the synchronous detection signal XDETP, and sends the pixel clock PCLK to the LD control unit 205 and the synchronous-detection lighting control unit 204.

The pixel-clock generating unit 202 includes the reference-clock generating unit 2021, the VCO-clock generating unit 2022, and the phase-synchronous-clock generating unit 2023.

Figure 3:
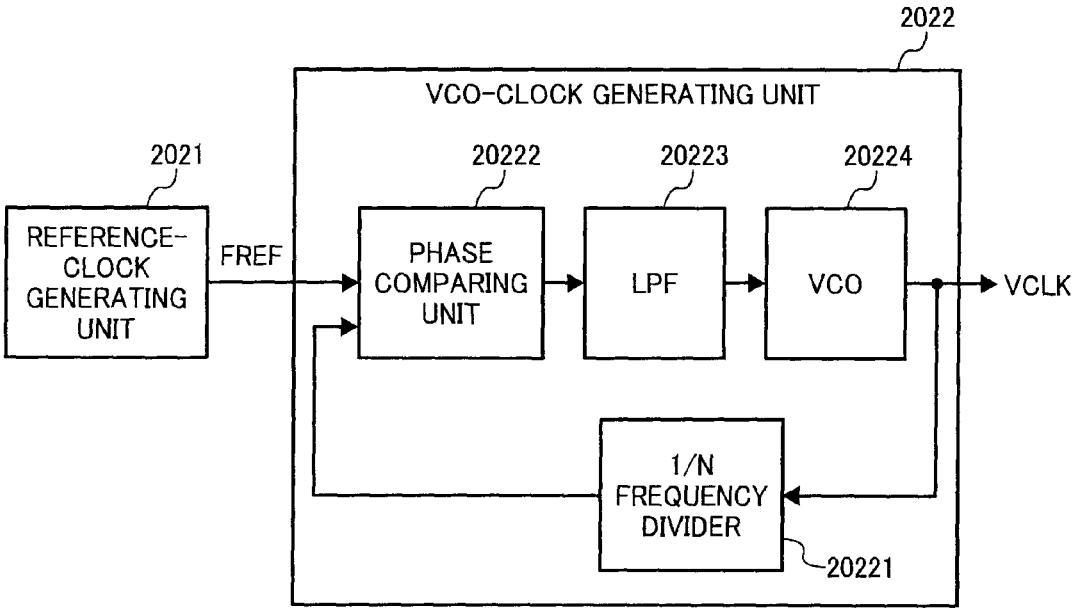
FIG. 3 is a block diagram of a voltage-controlled oscillator (VCO)-clock generating unit shown in FIG. 2.

FIG. 3 is a block diagram of the VCO-clock generating unit (phase locked loop circuit) 2022 of the pixel-clock generating unit 202. The VCO-clock generating unit 2022 inputs, to a phase comparing unit 20222, a reference clock signal FREF and a frequency-divided signal obtained by dividing frequency of a VCLK generated by the VCO-clock generating unit 2022 by N using a 1/N frequency divider 20221. The phase comparing unit 20222 compares phases of falling edges of the reference clock signal FREF and the frequency-divided signal, and an error component is output as constant current. A low pass filter (LPF) 20223 removes an unnecessary high-frequency component and noise from the signal and sends the signal to a VCO 20224. The VCO 20224 outputs oscillation frequency dependent on the output from the LPF 20223. Thus, the frequency of the VCLK can be changed by variable control of a dividing ratio N and the frequency of the FREF from the printer control unit 201. The phase-synchronous-clock generating unit 2023 generates the pixel clock PCLK synchronized with the synchronous detection signal XDETP from the VCLK generated by the VCO-clock generating unit 2022.

The synchronous-detection lighting control unit 204 forcibly turns ON the LD by activating an LD-forced-lighting signal BD to detect the synchronous detection signal XDETP. After the synchronous detection signal XDETP is detected, the synchronous-detection lighting control unit 204 turns ON the LD at a timing when the synchronous detection signal XDETP is assuredly detected without generating a flare light using the synchronous detection signal XDETP and the pixel clock PCLK. At this state, the synchronous-detection lighting control unit 204 generates the LD-forced-lighting signal BD for turning OFF the LD when detecting the synchronous detection signal XDETP, and sends the LD-forced-lighting signal BD to the LD control unit 205.

The LD control unit 205 performs a lighting control of the LD depending on the image data synchronized with the LD-forced-lighting signal BD for synchronous detection and the pixel clock PCLK. Then, the laser beam is emitted from an LD unit 122, reflected by the mirror surface of the polygon mirror 101 thereby being deflected, passes through the fθ lens 103, and scans the surface of the photosensitive element 106.

The motor drive control unit 206 controls the motor 102 to rotate at a predetermined rotation frequency based on a control signal from the printer control unit 201.

The write-start-position control unit 209 generates, based on the synchronous detection signal XDETP, the pixel clock PCLK, the control signal from the printer control unit 201, and the like, a main-scanning gate signal XLGATE and a sub-scanning gate signal XFGATE for determining an image-write start timing and an image width. The main-scanning gate signal XLGATE is in "L" (active) for the image width in the main-scanning direction, and sub-scanning gate signal XFGATE is in "L" (active) for the image width in the sub-scanning direction.

The first sensor 12 that detects the position-shift correction pattern is a reflection-type optical sensor, and the image pattern information detected by the sensor 12 is sent to the printer control unit 201. The printer control unit 201 calculates the amount of shift based on the image pattern information, generates correction data (set value) from the amount of shift, and stores the correction data in a correction-data storage unit 207. The correction-data storage unit 207 stores therein correction data for correcting image shift and magnification error, that is, data for determining timings of XLGATE and XFGATE and data for determining the frequency of the pixel clock PCLK. The correction data are set to each of the control units based on an instruction from the printer control unit 201. An operation panel 208 sends the contents of a performed key operation or input data to the printer control unit 201. The printer control unit 201 performs a control depending on the contents received from the operation panel 208.

Figure 4:
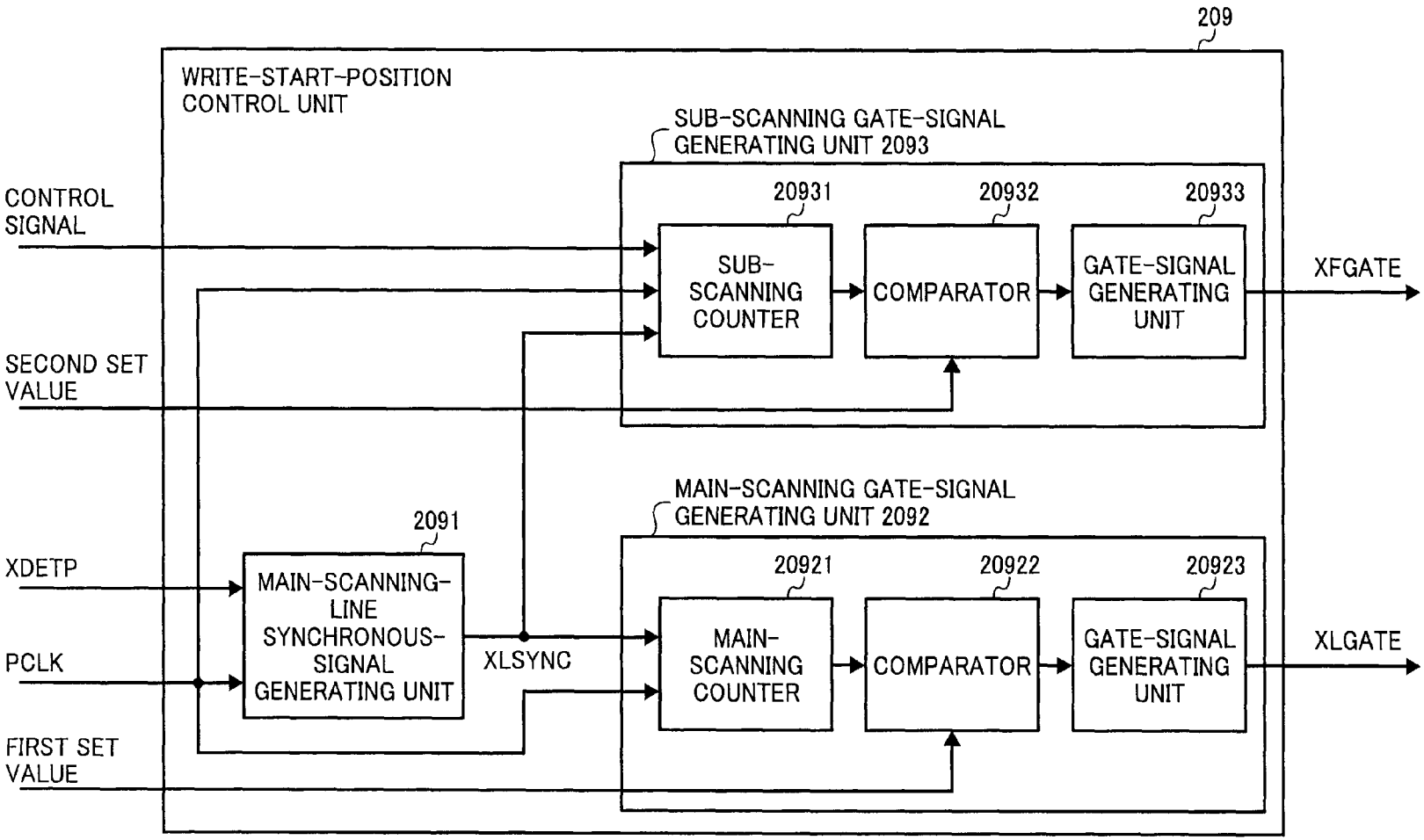
FIG. 4 is a block diagram of a write-start-position control unit shown in FIG. 2.

FIG. 4 is a block diagram of the write-start-position control unit 209. The write-start-position control unit 209 includes a main-scanning-line synchronous-signal generating unit 2091, a main-scanning gate-signal generating unit 2092, and a sub-scanning gate-signal generating unit 2093. The main-scanning-line synchronous-signal generating unit 2091 generates a signal XLSYNC for activating a main-scanning counter 20921 in the main-scanning gate-signal generating unit 2092 and a sub-scanning counter 20931 in the sub-scanning gate-signal generating unit 2093. The main-scanning gate-signal generating unit 2092 generates a signal XLGATE for determining a timing of acquiring an image signal (image write timing in the main-scanning direction). The sub-scanning gate-signal generating unit 2093 generates a signal XFGATE for determining a timing of acquiring an image signal (image write timing in the sub-scanning direction).

The main-scanning gate-signal generating unit 2092 includes the main-scanning counter 20921, a comparator 20922, and a gate-signal generating unit 20923. The main-scanning counter 20921 is activated by the XLSYNC and the PCLK. The comparator 20922 compares a counted value from the main-scanning counter 20921 with a first set value (correction data) from the printer control unit 201 and outputs a result of comparison from the comparator 20922. The gate-signal generating unit 20923 generates the XLGATE based on the result of the comparison from the comparator 20922.

The sub-scanning gate-signal generating unit 2093 includes the sub-scanning counter 20931, a comparator 20932, and a gate-signal generating unit 20933. The sub-scanning counter 20931 is activated by the XLSYNC and the PCLK. The comparator 20932 compares a counted value from the sub-scanning counter 20931 with a second set value (correction data) from the printer control unit 201 and outputs a result of comparison from the comparator 20932. The gate-signal generating unit 20933 generates the XFGATE based on the result of the comparison from the comparator 20932.

The write-start-position control unit 209 corrects a write position for each frequency of the clock PCLK in the main-scanning direction, i.e., for each dot. On the other hand, the write-start-position control unit 209 corrects a write position for each frequency of the XLSYNC in the sub-scanning direction, i.e., for each line. The correction data in the main-scanning direction (the first set value) and the correction data in the sub-scanning direction (the second set value) are stored in the correction-data storage unit 207.

Figure 5:
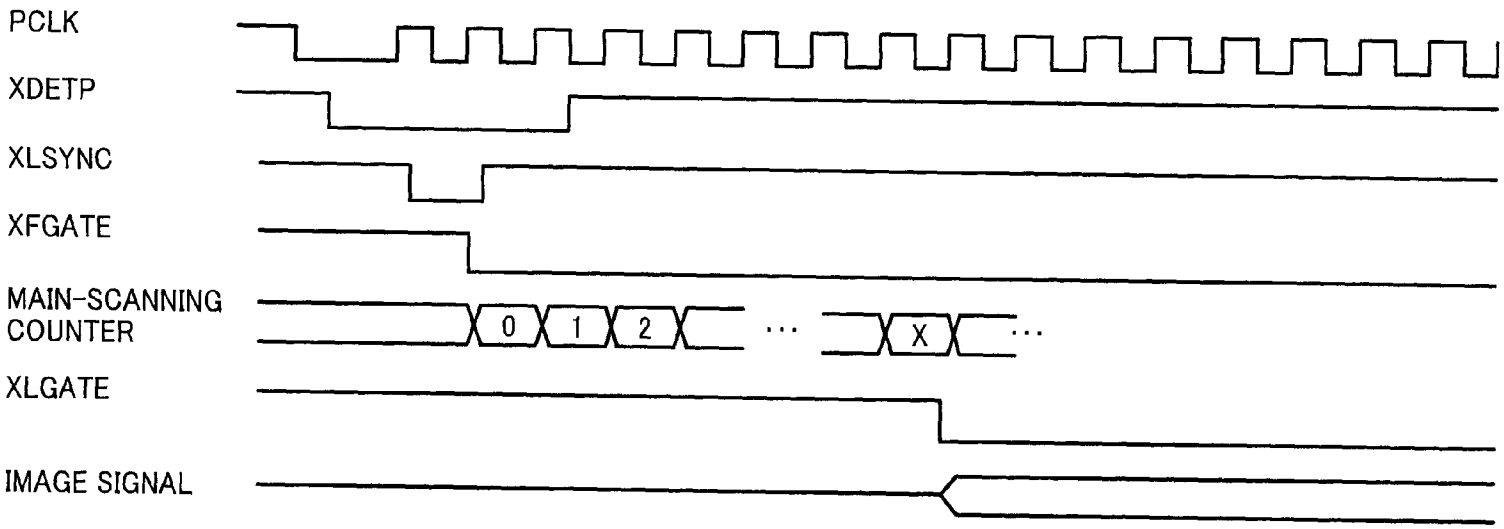
FIG. 5 is a timing chart of signals output from the write-start-position control unit in the main-scanning direction.

FIG. 5 is a timing chart of signals output from the write-start-position control unit 209 in the main-scanning direction. The main-scanning counter 20921 is reset by the XLSYNC and counted up by the PCLK. When the counted value reaches the first set value (in this case, "X") set by the printer control unit 201, the comparator 20922 outputs a comparison result, and the gate-signal generating unit 20923 changes the state of the XLGATE to "L" (active). The "L" state of the XLGATE is maintained over the image width in the main-scanning direction.

Figure 6:
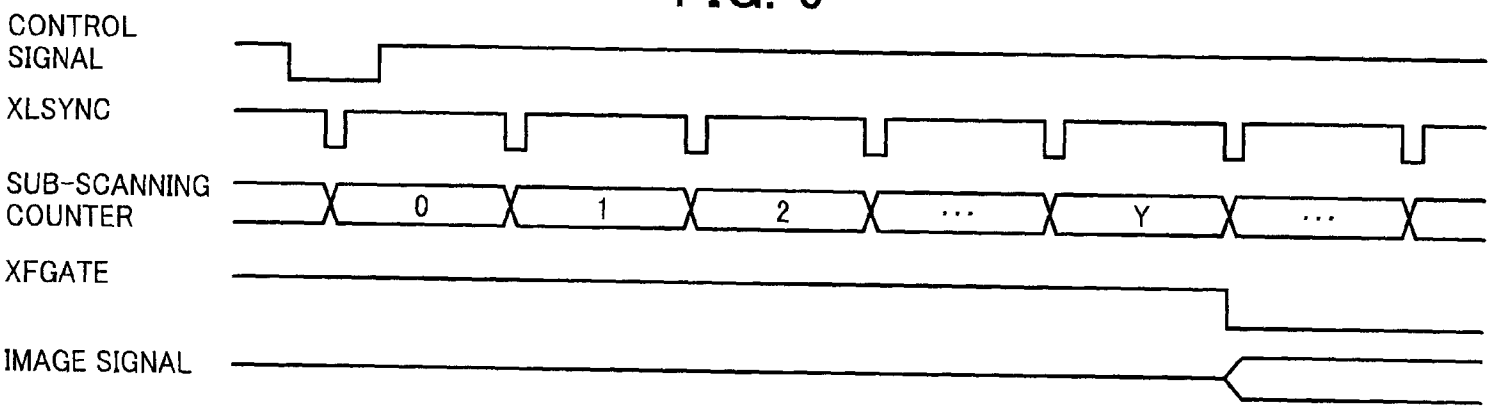
FIG. 6 is a timing chart of signals output from the write-start-position control unit in the sub-scanning direction.

FIG. 6 is a timing chart of signals output from the write-start-position control unit 209 in the sub-scanning direction. Timings at which the sub-scanning counter 20931 is reset by the control signal (image-write-start trigger signal) and counted up by the XLSYNC are different from the output timings in the main-scanning direction shown in FIG. 5. When the counted value reaches the second set value (in this case, "Y") set by the printer control unit 201, the comparator 20932 outputs a comparison result, and the gate-signal generating unit 20933 changes the state of the XFGATE to "L" (active). The "L" state of the XFGATE is maintained over the image width in the sub-scanning direction.

Thus, the write-start positions for the main-scanning direction and the sub-scanning direction are determined based on the synchronous signals instead of the control signal that is an asynchronous signal.

Figure 7:
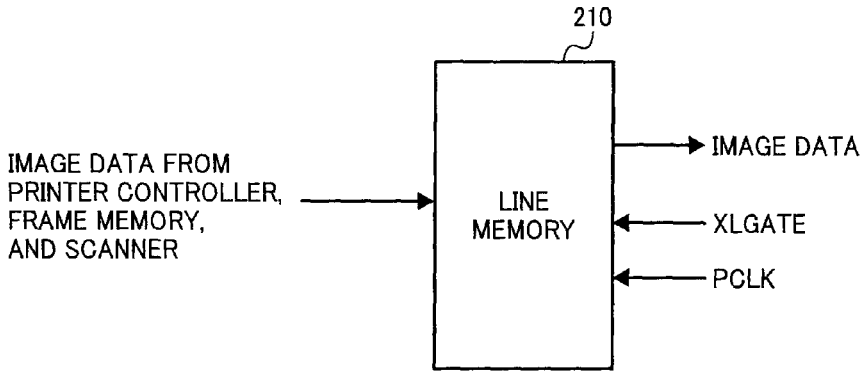
FIG. 7 is a schematic diagram of a line memory arranged in a preceding stage of the image-forming control unit to output image data to a laser diode (LD) control unit shown in FIG. 2.

FIG. 7 is a schematic diagram of a line memory 210 arranged in a preceding stage of the image-forming control unit to output image data to the LD control unit 205. The line memory 210 is configured to receive, at a timing of the XFGATE, image data acquired from a printer controller, a flame memory, or a scanner and output an image signal synchronized with the PCLK while the XLGATE is set to "L". The output image data is sent to the LD control unit 205, and the LD is turned ON at the same timing.

Figure 8:
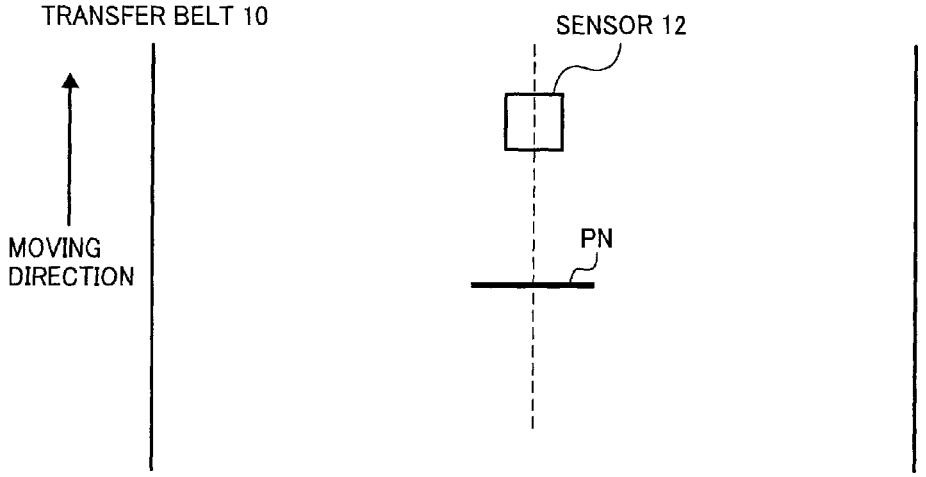
FIG. 8 is a schematic diagram of a position-shift correction pattern formed on a transfer belt shown in FIG. 1.

FIG. 8 is a schematic diagram of a position-shift correction pattern PN formed on the transfer belt 10. The position-shift correction pattern PN containing line images is formed on the transfer belt 10 at a preset timing. When the transfer belt 10 moves in a direction indicated by an arrow in FIG. 8, the sensor 12 detects the line images and send the line images to the printer control unit 201.

Figure 9:
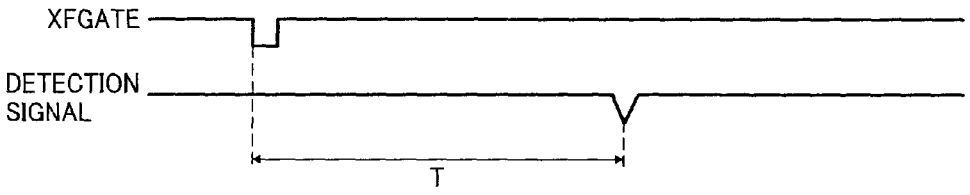
FIG. 9 is a timing chart for detecting the position-shift correction pattern shown in FIG. 8.

FIG. 9 is a timing chart for detecting the position-shift correction pattern shown in FIG. 8. The timing of detecting the position-shift correction pattern corresponds to a time T from the start of the write-start signal XFGATE of the position-shift correction pattern to a detection of the position-shift correction pattern. Therefore, the detection timing is set by measuring the time T.

Figure 10:
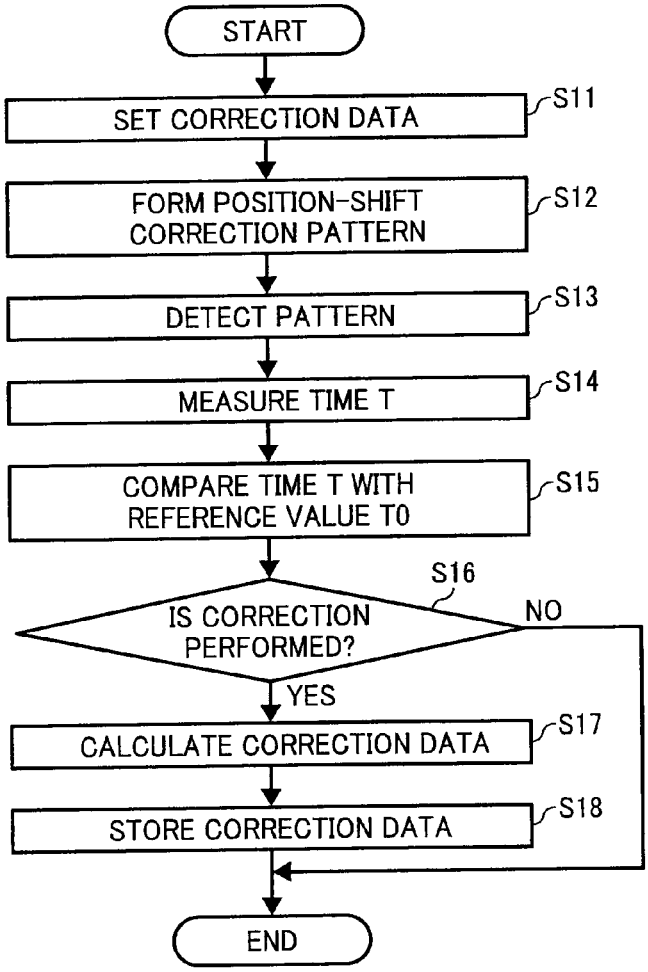
FIG. 10 is a flowchart of a position-shift correction process according to the first embodiment.

FIG. 10 is a flowchart of a position-shift correction process according to the first embodiment. The correction data (set value) stored in the correction-data storage unit 207 is set for each of the control units (Step S11). Specifically, correction data for a sub-scanning image position, a main-scanning image position, and image magnification in the main-scanning direction, which are determined by a previous correction operation, is set. If the correction operation has not been performed, initial values (factory set default values) are set. After the setting, the position-shift correction pattern PN shown in FIG. 8 is formed on the transfer belt 10 (Step S12), and the sensor 12 detects the position-shift correction pattern PN (Step S13). The printer control unit 201 measures the time T from the start of the write-start signal XFGATE of the position-shift correction pattern PN to a detection of the position-shift correction pattern PN based on the position-shift correction pattern PN detected by the sensor 12 (Step S14).

The time T is compared with the reference time T0 (Step S15), and whether correction is performed is determined (Step S16). If the amount of shift is half or more of a correction resolution, the correction is performed. If it is determined that the correction is performed (Yes at Step S16), the correction data is calculated (Step S17), and stored in the correction-data storage unit 207 (Step S18). The correction data, that is, the number of lines to be corrected, is calculated based on a time difference between the time T and the reference time T0, the transfer speed of the transfer belt, and the writing density in the sub-scanning direction. The correction data is used for a next image forming operation. The correction data corresponds to the set value of the XFGATE signal for determining the image position in the sub-scanning direction. If the correction is not performed (No at Step S16), the correction data is not updated.

The correction processing can be performed before starting the image forming operation, and can be performed between pages during a continuous printing. For detecting the position-shift correction pattern, it is possible to measure a time by calculating a midpoint of the output from the sensor as shown in FIG. 9, or by detecting the edge of the position-shift correction pattern.

As for the reference value T0, the time T at which the image position is aligned can be stored as the reference value T0. For example, the time T when the image position is adjusted at the time of delivery to a marketplace is measured and stored in a storage unit as the reference value T0.

Figure 11:
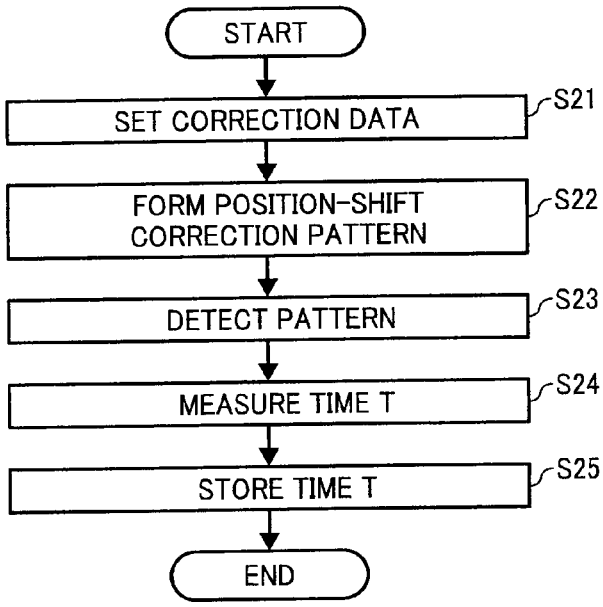
FIG. 11 is a flowchart of a reference-value measurement process according to the first embodiment.

The reference value T0 can be changed according to the first embodiment. That is, a mode for measuring the reference value T0 is set to easily change the reference value T0. FIG. 11 is a flowchart of a reference-value measurement process according to the first embodiment. Specifically, the reference value is acquired based on a measurement instruction from the operation panel 208. Similar to the position-shift correction process shown in FIG. 10, the correction data stored in the correction-data storage unit 207 is set in each of the control units (Step S21). Specifically, correction data for a sub-scanning image position, a main-scanning-image position, and image magnification in the main-scanning direction, which are determined by a previous correction operation, is set. If the correction operation has not been performed, initial values (factory set default values) are set. After the setting, the position-shift correction pattern PN shown in FIG. 8 is formed on the transfer belt 10 (Step S22), and the sensor 12 detects the position-shift correction pattern PN (Step S23). The printer control unit 201 measures the time T from the start of the write-start signal XFGATE of the position-shift correction pattern PN to a detection of the position-shift correction pattern PN based on detection data from the sensor 12 (Step S24), and the time T is stored as the reference time T0 (Step S25). The reference time T0 is then used in a subsequent image shift correction operation. Thus, the reference time T0 can be easily changed.

As described above, according to the first embodiment, a reference position of an image can be easily corrected. Furthermore, shift of the image position due to replacement of units can be easily corrected. Moreover, age-based color shift of an image can be corrected.

Figure 12:
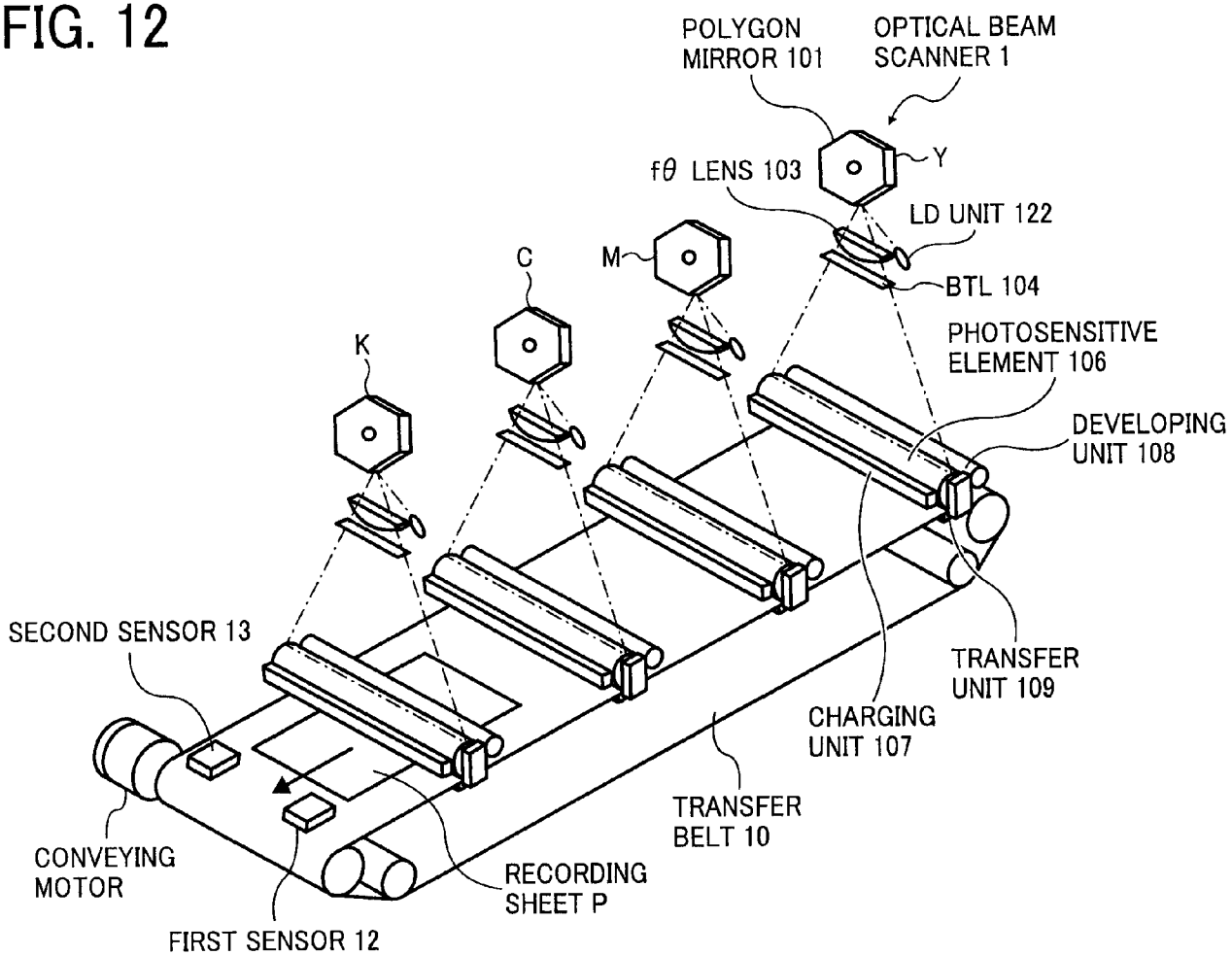
FIG. 12 is a schematic diagram of an imaging unit of a direct-transfer tandem-type image forming apparatus according to a second embodiment of the present invention.

FIG. 12 is a perspective schematic diagram of an imaging unit of a four-drum type image forming apparatus, that is, a direct-transfer tandem-type image forming apparatus according to a second embodiment of the present invention. The image forming apparatus according to the second embodiment includes four image forming units for forming a color image using four colors of yellow (Y), magenta (M), cyan (C), and black (BK). Specifically, the image forming apparatus includes the photosensitive element 106, the developing unit 108, the charging unit 107, the transferring unit 109, the cleaning unit 110 (see FIG. 1), and the optical beam scanner 1 for each of the colors. The image forming apparatus is a tandem type in which four image forming units shown in FIG. 1 are aligned. An image in a first color is formed on the recording sheet P conveyed by the transfer belt 10, and images in a second to a fourth colors are sequentially superimposed on the first color image to form a color image on the recording sheet P. The color image is then fixed by the fixing unit (not shown) on the recording sheet P. The image forming unit is the same as that described in connection with FIG. 1, and the optical beam scanner 1 having the same configuration described in the first embodiment is arranged for each color.

A second sensor 13 is arranged in addition to the first sensor 12 for detecting the position-shift correction pattern according to the second embodiment. The first and the second sensors 12 and 13 are reflection-type optical sensors that detect the position-shift correction patterns (straight-line pattern and oblique-line pattern) formed on the transfer belt 10. The image position of an image in each color, position shift between images in different colors in the main-scanning direction and the sub-scanning direction, and the image magnification error in the main-scanning direction are corrected based on a result of detection of the position-shift correction pattern.

Figure 13:
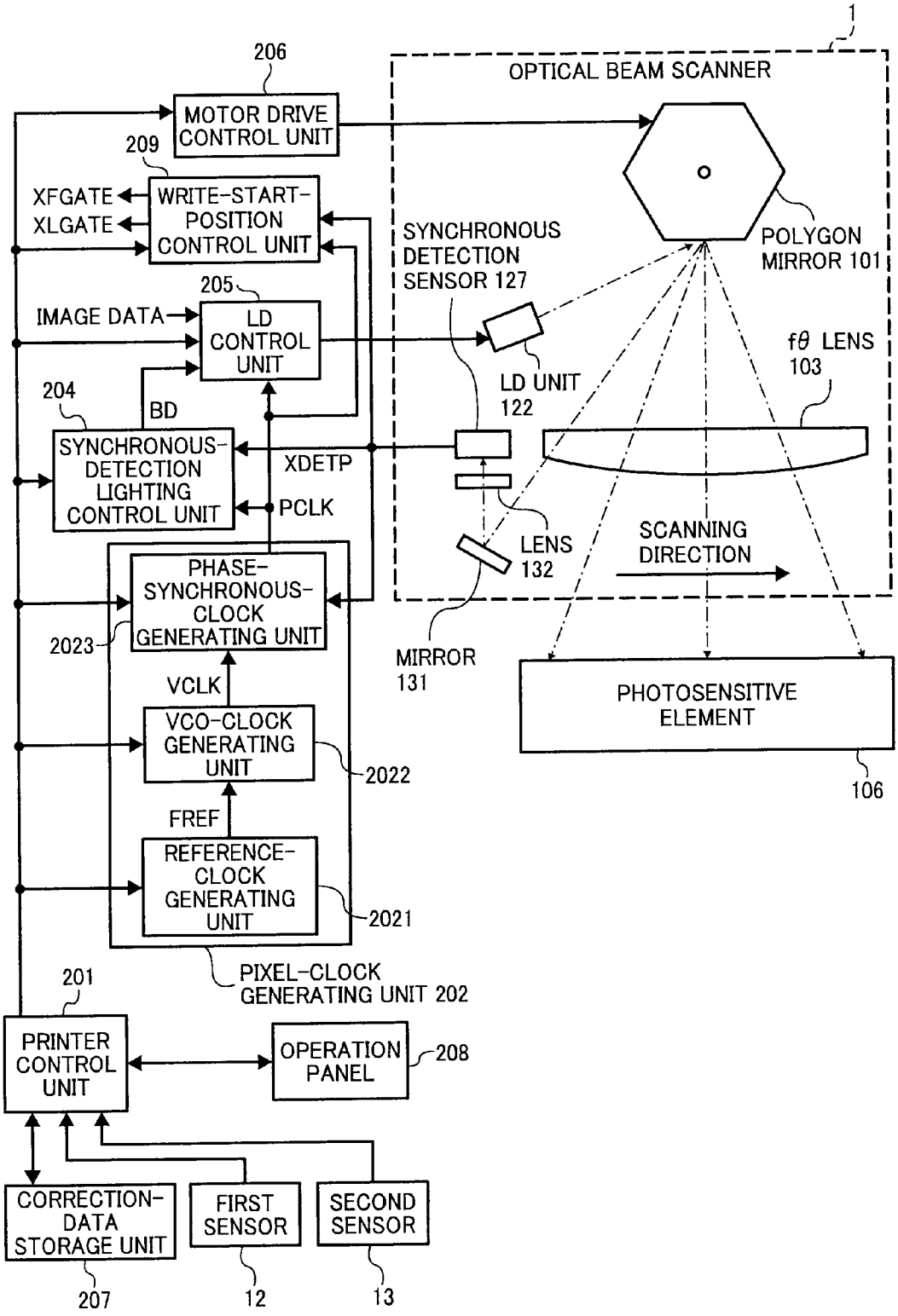
FIG. 13 is a schematic diagram of an image-forming control unit of the image forming apparatus shown in FIG. 12.

FIG. 13 is a schematic diagram of an image-forming control unit of the image forming apparatus shown in FIG. 12. The difference from the image-forming control unit in the first embodiment is that the sensor 13 is arranged in addition to the sensor 12 for detecting the position-shift correction pattern. Other configurations are the same as that of the first embodiment. The units other than the printer control unit 201, the correction-data storage unit 207, the first and the second sensors 12 and 13, and the operation panel 208 are arranged for each color.

Figure 14A:
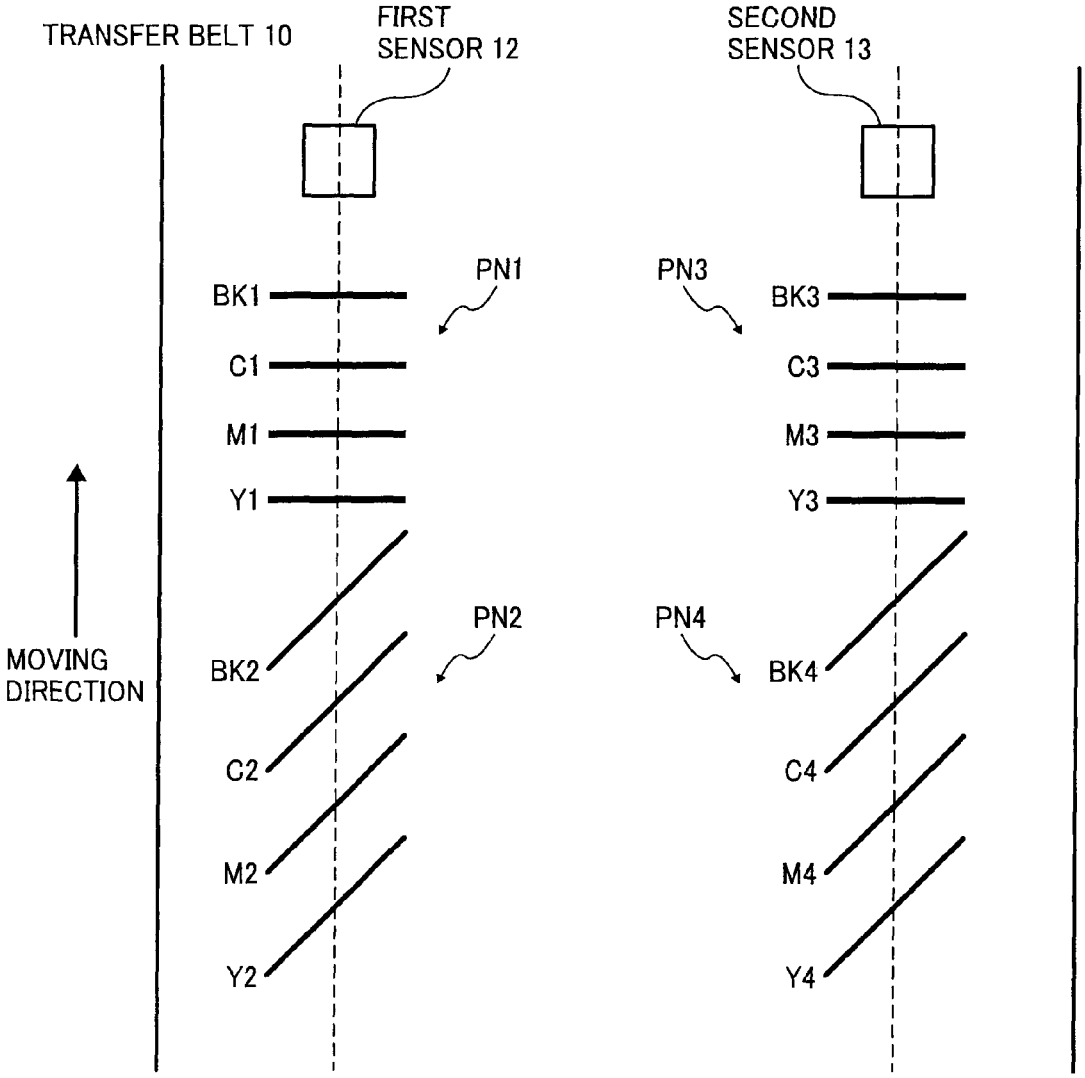
FIG. 14A is a schematic diagram for explaining a relationship between a position-shift correction pattern formed on a transfer belt and a sensor according to the second embodiment.

FIG. 14A is a schematic diagram for explaining a relationship between a position-shift correction pattern formed on the transfer belt 10 and the sensors 12 and 13. The sensor 12 detects the position-shift correction patterns PN1 and PN2 (straight-line pattern and oblique-line pattern) formed on the transfer belt 10. Similarly, the sensor 13 detects the position-shift correction patterns PN3 and PN4 (straight-line pattern and oblique-line pattern) formed on the transfer belt 10. The printer control unit 201 corrects the position shift between images in different colors in the main-scanning direction and the sub-scanning direction and the magnification error based on a detection result. The position-shift correction patterns PN1, PN2, PN3, PN4 are formed with predetermined intervals kept with each other in the sub-scanning direction as shown in FIG. 14A. The position-shift correction pattern PN1 contains straight-line patterns BK1, C1, M1, Y1 having predetermined lengths in the main-scanning direction arranged on the end portion of the transfer belt 10. Similarly, the position-shift correction pattern PN3 contains straight-line patterns BK3, C3, M3, Y3 on the other end portion of the transfer belt 10. The position-shift correction pattern PN2 contains oblique-line patterns BK2, C2, M2, Y2 inclined by 45 degrees against the longitudinal direction (moving direction) of the transfer belt 10 and in the sub-scanning direction of the pattern groups on the downstream side in the moving direction of the transfer belt 10. Similarly, the position-shift correction pattern PN4 contains oblique-line patterns BK4, C4, M4, Y4 arranged in the same manner. The first sensor 12 detects the position-shift correction patterns BK1, C1, M1, Y1, BK2, C2, M2, and Y2 arranged on one end portion of the transfer belt 10. The second sensor 13 detects the position-shift correction patterns BK3, C3, M3, Y3, BK4, C4, M4, and Y4 on the other end portion of the transfer belt 10.

When the transfer belt 10 moves in the direction indicated by an arrow shown in FIG. 14A, the straight-line patterns BK1, C1, M1, Y1, BK3, C3, M3, and Y3, and the oblique-line patterns BK2, C2, M2, Y2, BK4, C4, M4, and Y4 are detected by the first and the second sensors 12 and 13. Then, the printer control unit 201 calculates the amount of shift (time) of each pattern with respect to each BK pattern. The detection timing of the oblique-line patterns is changed if the image position in the main-scanning direction is misaligned and an image magnification error occurs in the main-scanning direction. The detection timing of the straight-line patterns is changed if the image position in the sub-scanning direction is misaligned.

Figure 14B:
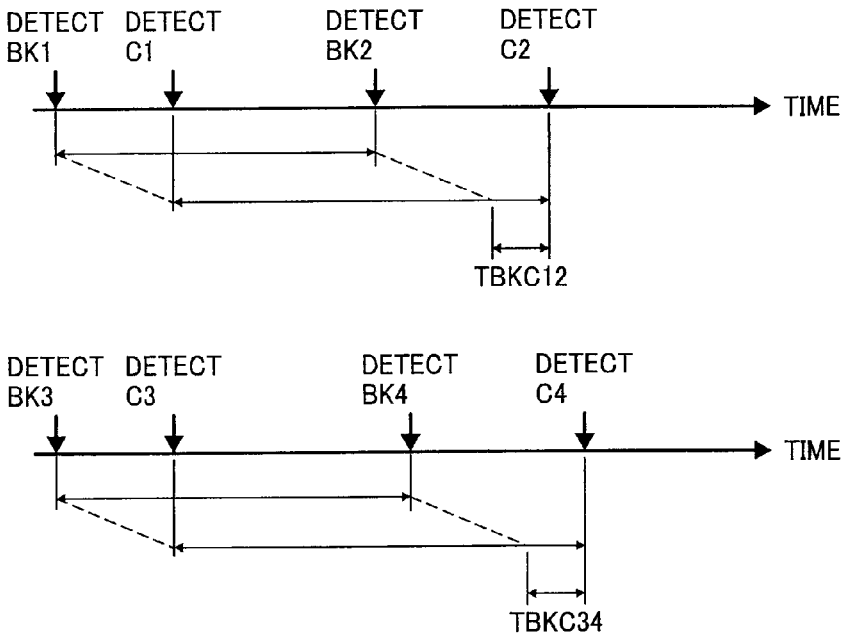
FIG. 14B is a schematic diagram for explaining a calculation of a magnification error in the main-scanning direction.

FIG. 14B is a schematic diagram for explaining a calculation of the magnification error in the main-scanning direction. Specifically, a time from detection of the pattern BK1 to detection of the pattern BK2 is set as a reference time in the main-scanning direction, and a time from detection of the position-shift correction pattern C1 to detection of the position-shift correction pattern C2 is compared with the reference time to calculate the amount of shift TBKC 12. Furthermore, a time from detection of the pattern BK3 to detection of the pattern BK4 is set as a reference time, and a time from detection of the position-shift correction pattern C3 to detection of the position-shift correction pattern C4 is compared with the reference time to calculate the amount of shift TBKC 34. Then, the amount of magnification error of a cyan image to a black image is obtained by $$\text{Magnification error}=TBKC\ 34-TBKC\ 12$$

Then, the image clock frequency is changed in accordance with the amount of the magnification error. A value obtained by subtracting a time-shift amount (correction amount) due to the correction of the magnification error at a position of the first sensor 12 from the TBKC 12 corresponds to the amount of shift of the cyan image to the black image in the main-scanning direction. Therefore, the timing of the XLGATE signal for determining a write start timing is changed in accordance with the obtained value. The same operation is performed for a magenta image and a yellow image.

For the sub-scanning direction, assuming that an ideal time is Tc, a time from detection of the pattern BK1 to detection of the position-shift correction pattern C1 is TBKC1, and a time from detection of the pattern BK3 to detection of the position-shift correction pattern C3 is TBKC3, the shift of the cyan image to the black image in the sub-scanning direction is obtained by $$\text{Shift of the cyan image}=((TBKC3+TBKC1)/2)-Tc$$

Therefore, the timing of the XFGATE signal for determining a write start timing is changed in accordance with the obtained value. The same operation is performed for the magenta image and the yellow image.

Figure 15:
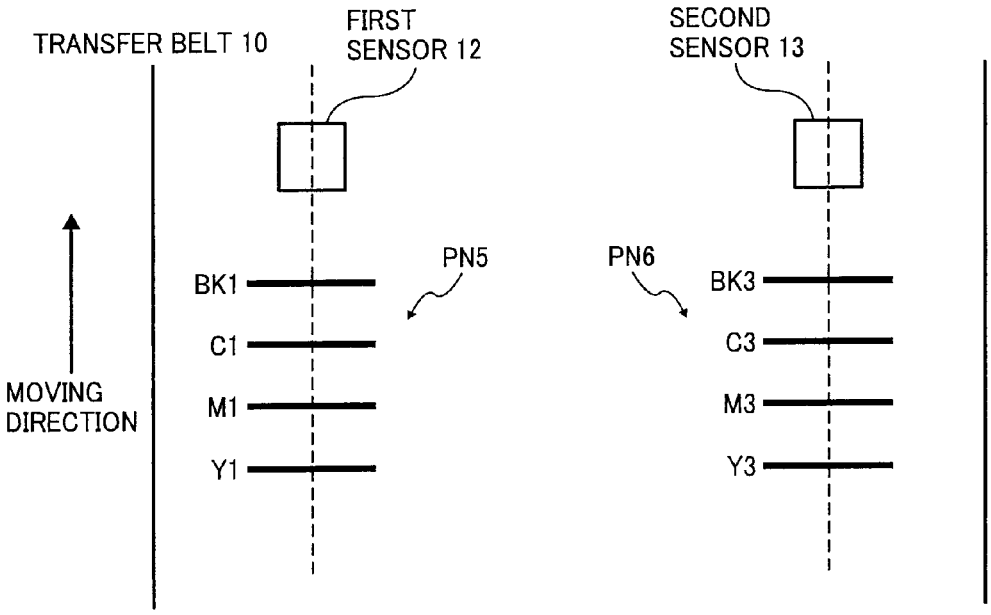
FIG. 15 is a schematic diagram of position-shift correction patterns for measuring a reference time formed on the transfer belt according to the second embodiment.

FIG. 15 is a schematic diagram of shift correction patterns PN5 and PN6 formed on the transfer belt 10. The patterns PN5 and PN6 are for measuring the reference time T0 to correct a position of the image in each color in the sub-scanning direction, similar to the straight-line patterns PN1 and PN3 shown in FIG. 14A.

Figure 16:
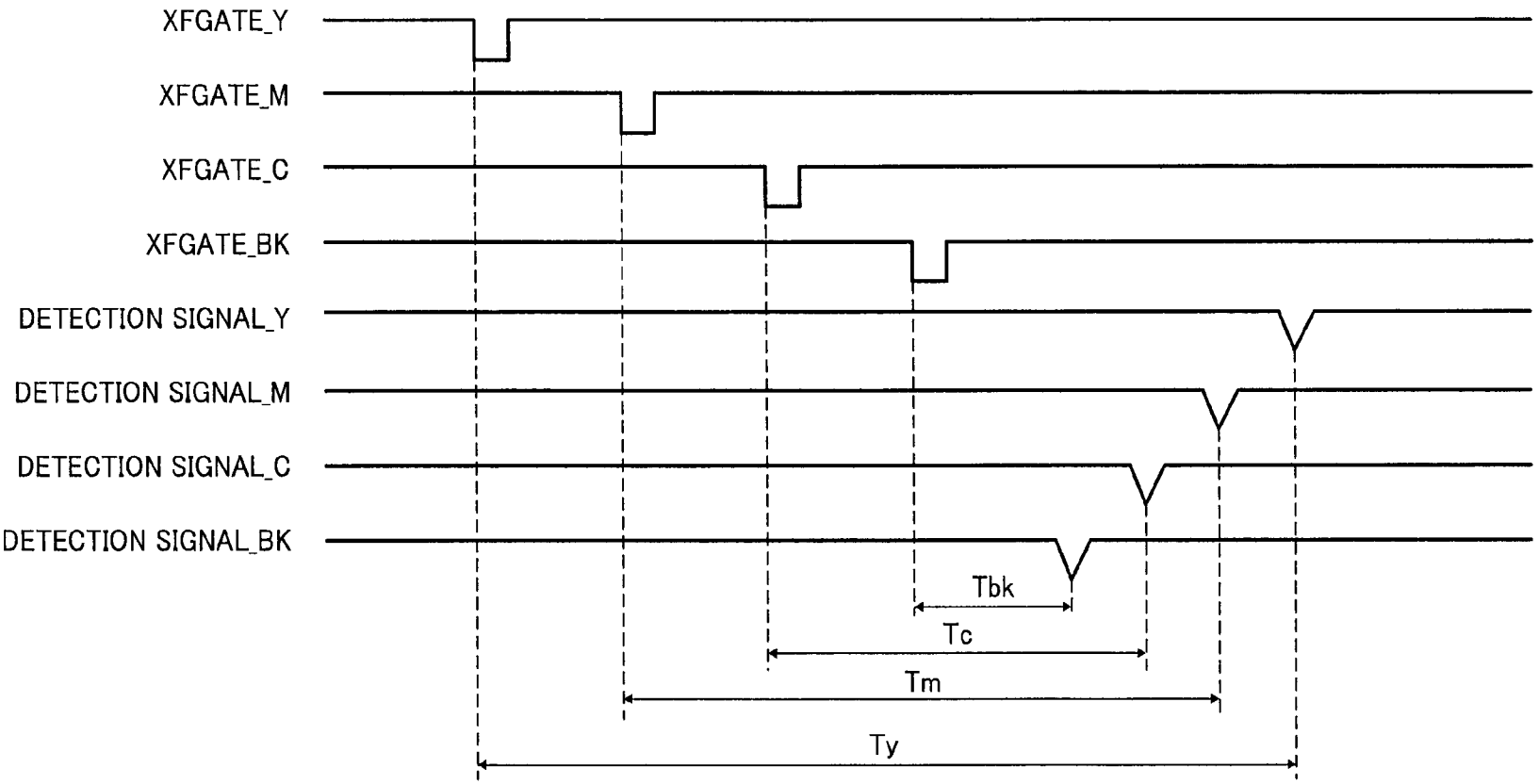
FIG. 16 is a timing chart for detecting the position-shift correction patterns shown in FIG. 15.

FIG. 16 is a timing chart of a timing of detecting the position-shift correction patterns PN5 and PN6. The printer control unit 201 measures times Ty, Tm, Tc, Tbk from detection of write-start signals XFGATE_Y, XFGATE_M, XFGATE_C, and XFGATE_BK for corresponding shift correction patterns to detection of the position-shift correction patterns for corresponding colors.

Figure 17:
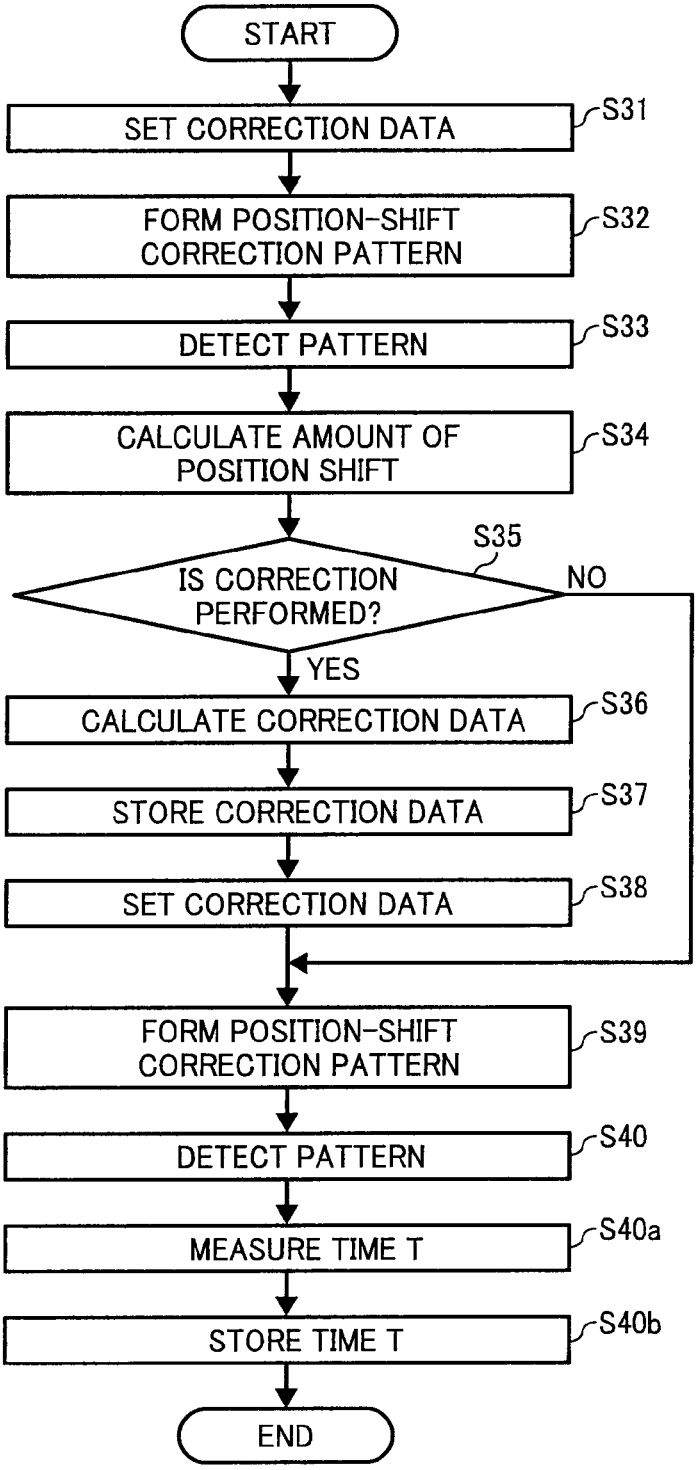
FIG. 17 is a flowchart of a reference-time measurement process according to the second embodiment.

FIG. 17 is a flowchart of a reference-time measurement process according to the second embodiment. The correction data stored in the correction-data storage unit 207 is set to each of the control units (Step S31). The correction data is, similar to the first embodiment, for a sub-scanning image position, a main-scanning-image position, and image magnification in the main-scanning direction, which are determined by a previous correction operation. If the correction operation has not been performed, initial values (factory set default values) are set. After the setting, the position-shift correction patterns PN1, PN2, PN3, and PN4 shown in FIG. 14A are formed on the transfer belt 10 (Step S32). The first and the second sensors 12 and 13 detect the position-shift correction patterns PN1, PN2, PN3, and PN4 (Step S33), and the printer control unit 201 calculates the amount of shift of images in each color against the corresponding black images (Step S34). Then, the printer control unit 201 determines whether the correction is performed based on the calculated amount of shift (Step S35). If the amount of shift is half or more of the correction resolution, the correction is performed.

If it is determined that the correction is performed (Yes at Step S35), the correction data is calculated (Step S36), stored in the correction-data storage unit 207 (Step S37), and set to each of the control units (Step S38). The correction data is the set value of the image clock frequency for determining the image magnification error in the main-scanning direction, the set value of the XLGATE signal for determining the image position in the main-scanning direction, and the set value of the XFGATE signal for determining the image position in the sub-scanning direction. If it is determined that the correction is not performed (No at Step S35), the correction data is not updated.

The position-shift correction patterns PN5 and PN6 shown in FIG. 15 are formed on the transfer belt 10 (Step S39), and the first and the second sensors 12 and 13 detect the patterns PN5 and PN6 (Step S40). The printer control unit 201 measures times Ty, Tm, Tc, and Tbk from detection of the position-shift correction pattern write-start signal XFGATE_Y, XFGATE_M, XFGATE_C, and XFGATE_BK to detection of shift correction patterns for corresponding colors (Step S40*a*). According to the second embodiment, because the first and the second sensors 12 and 13 are provided, an average of outputs from the first and the second sensors 12 and 13 is calculated and a calculated average is stored as the reference value T0 in the correction-data storage unit 207 (Step S40*b*).

As shown in FIG. 16, it is possible to measure a time by calculating a midpoint of the output of the sensor to detect the patterns, or by detecting the edge of the patterns.

Figure 18:
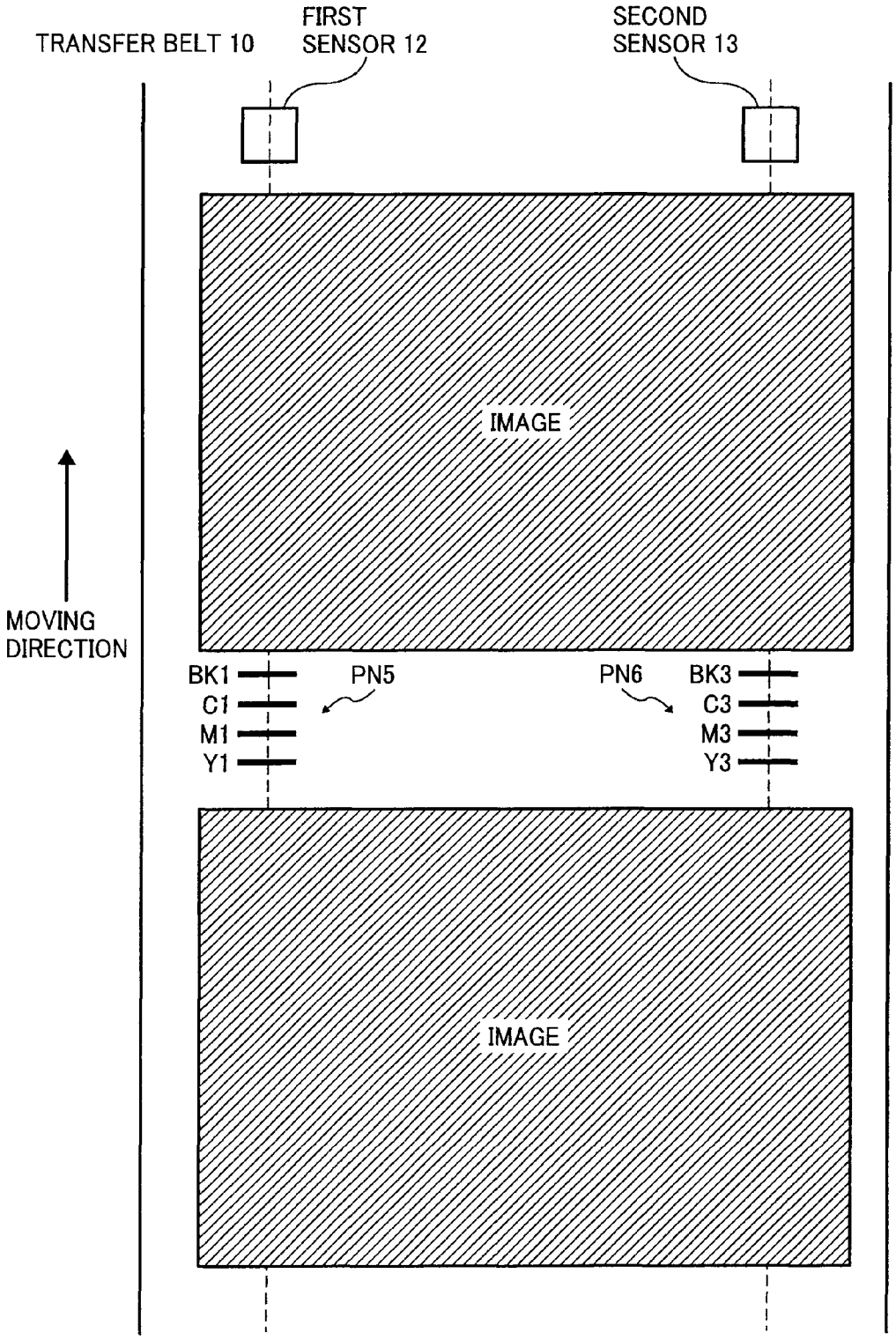
FIG. 18 is a schematic diagram of position-shift correction patterns formed on the transfer belt between recording sheets.

FIG. 18 is a schematic diagram of a position-shift correction patterns PN5 and PN6 formed on the transfer belt 10 between recording sheets. In this example, the position-shift correction patterns PN5 and PN6 are formed between pages (sheets) during the continuous printing in the situation where the processing shown in FIG. 17 has been completed and the shift of images in different colors is resolved while the reference time is stored in the storage unit. The patterns PN5 and PN6 shown in FIG. 18 are the same as those shown in FIG. 15.

Figure 19:
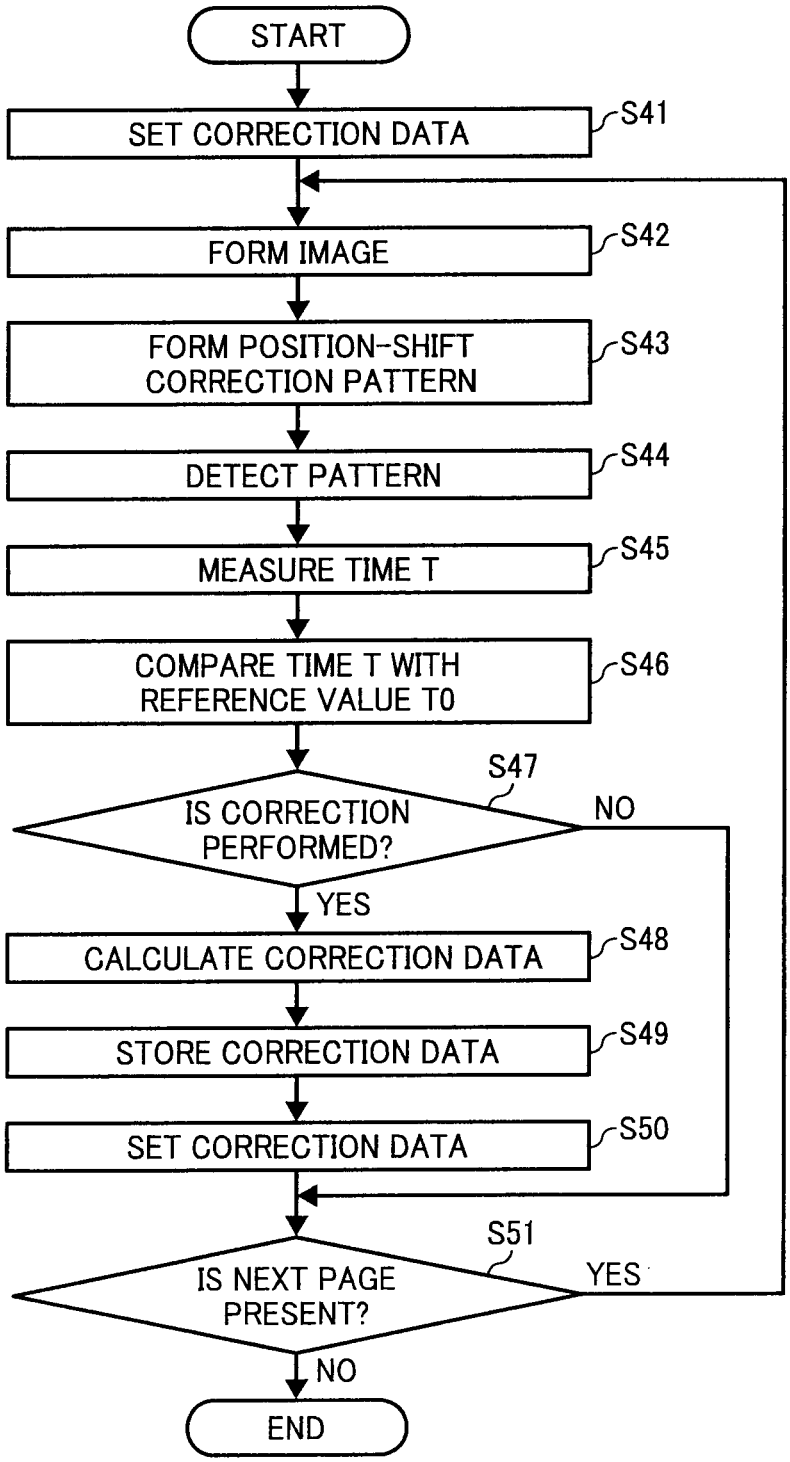
FIG. 19 is a flowchart of a position-shift correction process according to the second embodiment.

FIG. 19 is a flowchart of a position-shift correction process according to the second embodiment. This process is performed during the image forming operation. The correction data stored in the correction-data storage unit 207 is set to each of the control units (Step S41). The correction data is, similar to those at steps S101 and S201, for a sub-scanning image position, a main-scanning-image position, and image magnification in the main-scanning direction, which are determined by a previous correction operation. If the correction operation has not been performed, initial values (factory set default values) are set. After the setting, the image forming operation is started (Step S42). When image write for a first page (first sheet) is finished, the position-shift correction patterns PN5 and PN6 are formed on the transfer belt 10 (Step S43). The first and the second sensors 12 and 13 then detect the patterns PN5 and PN6 (Step S44).

When the patterns PN5 and PN6 are detected, the printer control unit 201 measures times Ty, Tm, Tc, and Tbk from detection of the write-start signal XFGATE_Y, XFGATE_M, XFGATE_C, and XFGATE_BK to detection of shift correction patterns for corresponding colors (Step S45). Each of the times Ty, Tm, Tc, and Tbk is compared with the reference value T0 for corresponding color stored in the correction-data storage unit 207 (Step S46), and whether the correction is performed is determined (Step S47). If the amount of shift is half or more of the correction resolution, the correction is performed.

When it is determined that the correction is performed (Yes at Step S47), the correction data is calculated (Step S48). The correction data is then stored in the correction-data storage unit 207 (Step S49) and set to each of the control units (Step S50). The correction data is the set value of the XFGATE signal for determining the position of the image in each color in the sub-scanning direction. If the correction is not performed (No at Step S47), the correction data is not updated. If a next page is present (Yes at Step S51), the image forming operation is repeated from step S42.

It is not necessary to perform the above processes every interval of pages as described in the second embodiment. For example, the processes can be performed every 100 pages. It is also possible to change the number of pages by the operation panel. Although the updated correction data is used from a next page in the process shown in FIG. 19, if the correction is not finished by a next image forming operation, the updated correction data is used from a few pages later.

The position-shift correction patterns PN5 and PN6 shown in FIG. 18 contain four patterns for four colors. However, the number of patterns can be one or three for one or three colors. With such a position-shift correction pattern, a color of a pattern is changed with respect to each page and a time for the pattern in the formed color is measured.

As described above, according to the second embodiment, position shift between images in different colors can be corrected, and a reference position of the image can be easily corrected.

A third embodiment of the present invention is described below. The position-shift correction patterns shown in FIG. 15 are not used for measuring the reference time T0, and the straight-line patterns for correcting a position shift shown in FIG. 14 are alternatively used for the measurement of the reference time T0. Specifically, the reference time T0 is measured by using the position-shift correction patterns PN1 and PN3 instead of using the position-shift correction patterns PN5 and PN6. Other configurations of the image forming apparatus, the optical beam scanner, the image-forming control unit, and the position-shift correction patterns, and the position-shift correction process are the same as those described in the second embodiment.

Figure 20:
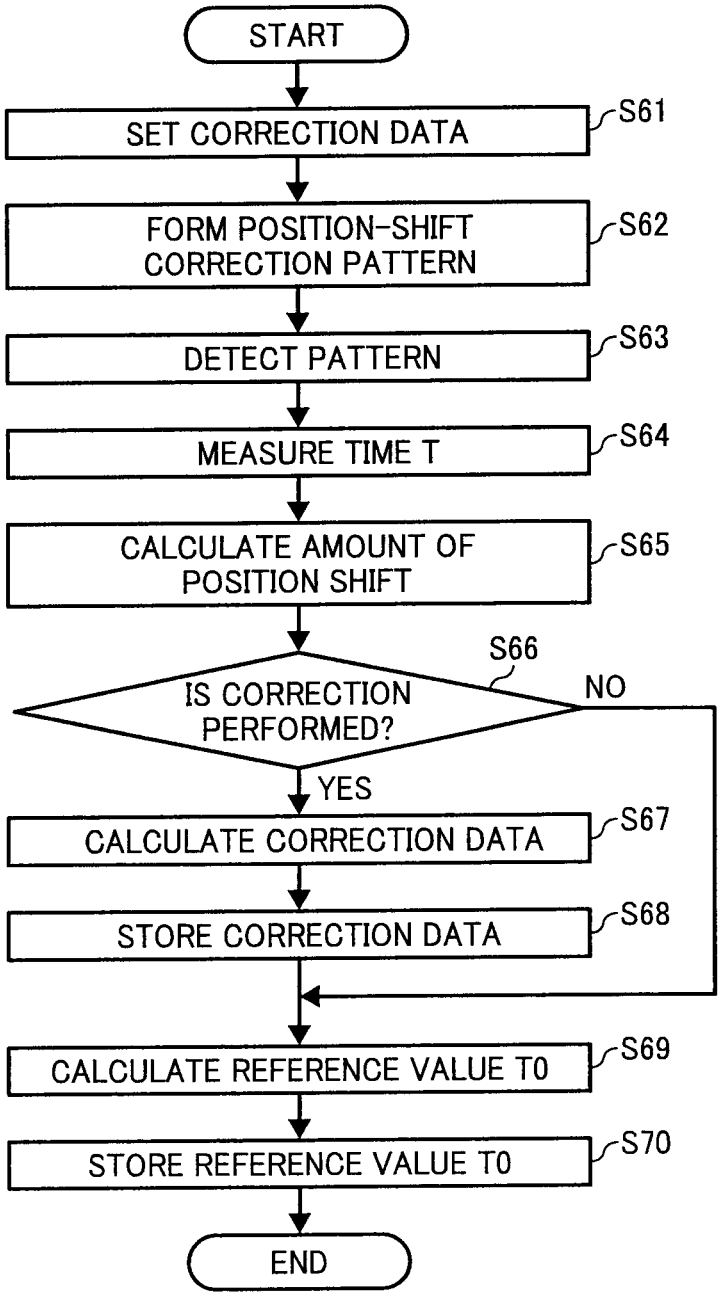
FIG. 20 is a flowchart of a reference-time measurement process according to a third embodiment of the present invention.

FIG. 20 is a flowchart of a reference-time measurement process according to the third embodiment. The correction data stored in the correction-data storage unit 207 is set in each of the control units (Step S61). The setting is the same as that at steps S11, S31, and S41. After the setting, the position-shift correction patterns PN1 to PN4 shown in FIG. 14 are formed on the transfer belt 10 (Step S62), and the first and the second sensors 12 and 13 detect the position-shift correction patterns PN1 to PN4 (Step S63). As shown in FIG. 16, the printer control unit 201 measures times Ty, Tm, Tc, and Tbk from detection of the write-start signal XFGATE_Y, XFGATE_M, XFGATE_C, and XFGATE_BK for the position-shift correction patterns PN1 and PN3 to detection of shift correction patterns for corresponding colors (Step S64). The amount of shift of images in each color with respect to each black image is calculated (Step S65), and whether correction is performed is determined (Step S66). Similar to steps S16 and S25, the correction is performed if the amount of shift is half or more of the correction resolution.

If it is determined that the correction is to be performed (Yes at Step S66), the correction data is calculated (Step S67). The correction data is then stored in the correction-data storage unit 207 (Step S68), and set to each of the control units. The correction data is the set value of the image clock frequency for determining image magnification error in the main-scanning direction, the set value of the XLGATE signal for determining the image position in the main-scanning direction, and the set value of the XFGATE signal for determining the image position in the sub-scanning direction. If the correction is not to be performed (No at Step S66), the correction data is not updated. The reference time T0 for each color is calculated by addition or subtraction of the correction value for each color to/from the measured times Ty, Tm, Tc, and Tbk (Step S69), and the reference time T0 is stored in the correction-data storage unit 207 (Step S70).

The black (BK) image does not have corresponding correction data; therefore, a measured value is used as the reference time.

If a measured value is used as correction data of the black image, the reference time T0 of the black image is measured and stored in advance. At this state, the time T at which the image position is not shifted is stored as the reference time T0. For example, the time T when the image position is adjusted at the time of shipping from a factory is measured and stored in a storage unit as the reference value T0.

Figure 21:
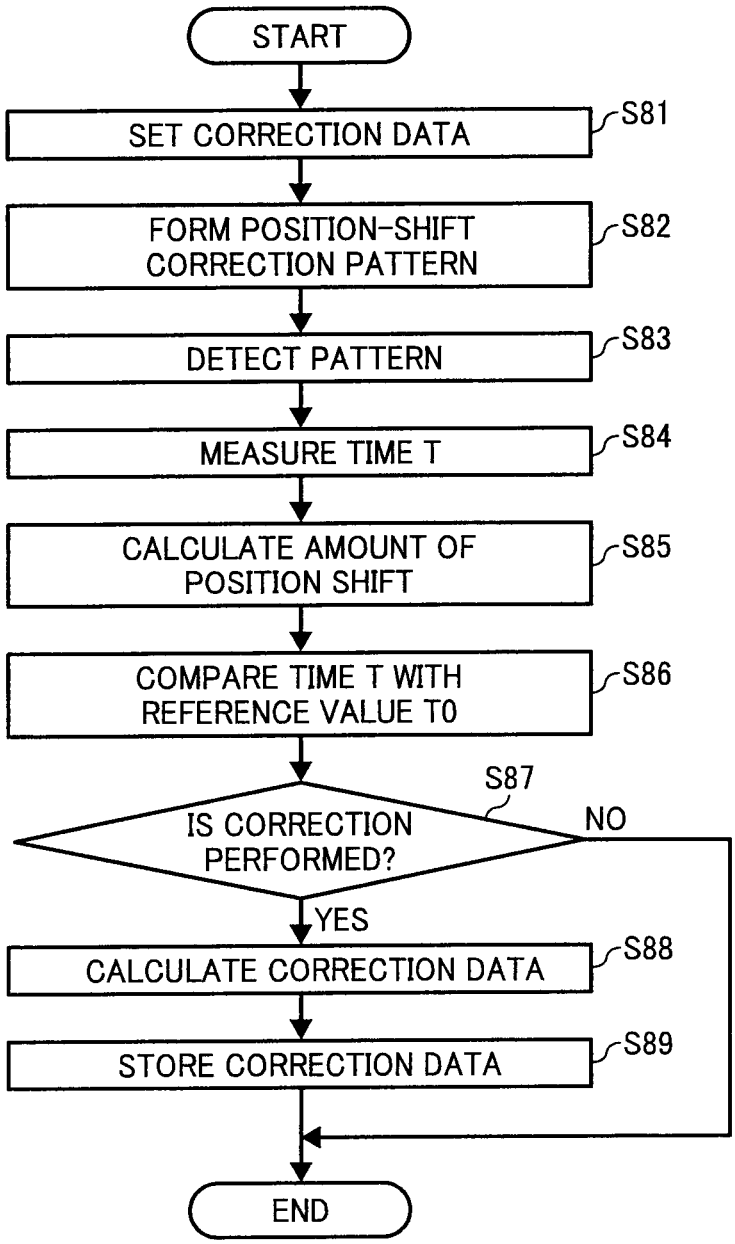
FIG. 21 is a flowchart of a position-shift correction process according to the third embodiment.

FIG. 21 is a flowchart of a position-shift correction process according to the third embodiment. The correction data stored in the correction-data storage unit 207 is set to each of the control units (Step S81), similar to step S61. After the setting, the position-shift correction patterns PN1 to PN4 shown in FIG. 14 are formed on the transfer belt 10 (Step S82), and the first and the second sensors 12 and 13 detect the position-shift correction patterns PN1 to PN4 (Step S83). The printer control unit 201 measures a time Tbk from detection of the write-start signal XFGATE_BK for shift correction pattern of the black image to detection of shift correction pattern for the black image (Step S84). The amount of shift of black image is then calculated (Step S85).

The time Tbk is compared with the reference value T0 (Step S86), and whether correction of the position of the black image, and positions and magnifications of images in other colors with respect to the black image are necessary is determined (Step S87). If the amount of shift is half or more of the correction resolution, the correction is performed at Step S87.

If the correction is performed (Yes at Step S87), the correction data is calculated (Step S88), and the correction data is stored in the correction-data storage unit 207 (Step S89). The correction data is the set value of the image clock frequency for determining image magnification in the main-scanning direction, the set value of the XLGATE signal for determining the image position in the main-scanning direction, and the set value of the XFGATE signal for determining the image position in the sub-scanning direction. If the position of the black image is corrected, the correction value of the black image needs to be added or subtracted to/from the correction values of images in other colors. If the correction is not performed (No at Step S87), the correction data is not updated.

As described above, a mode for using the measured value as the correction data of the black image can be selected from the operation panel 208. Accordingly, the reference value can be easily changed. The process of measuring the reference value is the same as described in connection with FIG. 11.

The correction data stored in the correction-data storage unit 207 is set to each of the control units at the time of image forming operation.

The direct-transfer tandem type image forming apparatus is described in the above embodiments. However, an intermediate-transfer tandem type image forming apparatus can be used, in which each color image formed on the photosensitive element 106 for each color of Y, M, C, BK is superimposed one on top of the other on an intermediate transfer belt to form a full-color image, and the full-color image is transferred from the intermediate transfer belt to the recording sheet.

As described above, according to the third embodiment, the same effects as described in the first and the second embodiments can be attained. Furthermore, it is possible to reduce a correction time in the shift correction process.

The present invention in its broader aspects is not limited to the specific details and representative embodiments shown and described herein. Accordingly, various modifications can be made without departing from the spirit or scope of the general inventive concept as defined by the appended claims and their equivalents. Furthermore, constituent elements in each embodiment can be omitted as appropriate, or constituent elements over the embodiments can be integrated as appropriate.

As describe above, according to an aspect of the present invention, the image forming apparatus is controlled based on a measured time from detection of a signal for controlling a timing of start of image write to detection of the position-shift correction pattern. Therefore, position shift between images in different colors and the reference position of the image can be easily corrected.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a pattern forming unit that forms a pattern for correcting a position shift of an image;

a detecting unit that detects the pattern;

a measuring unit that measures a first time from a start of a control signal for controlling timing to start forming the image until a detection of the pattern; and a control unit that controls position-shift corrections of a position of forming the image based on the time measured by the measuring unit and a reference time, wherein for a first position-shift correction, the control unit compares the first time measured by the measuring unit with the reference time and controls a position of forming the image based on a difference between the first time and the reference time, the reference time being the time at which the image position is aligned, and for subsequent position-shift corrections, the control unit sets the reference time as a time measured immediately after a previous position-shift correction, and controls the position of forming the image based on the difference between a first time measured by the measuring unit corresponding to the previous position-shift correction and the reference time.

2. The image forming apparatus according to claim 1, further comprising:

a color image forming unit that includes a plurality of image forming units for different colors and forms a full color image by superimposing images of different colors, wherein, for each image forming unit, the pattern forming unit forms a corresponding pattern for correcting the position shift of the image, the detecting unit detects the corresponding pattern, the measuring unit measures a corresponding first time from the start of the control signal to the detection of the corresponding pattern, and the control unit controls position-shift corrections of a corresponding position of forming the image.

3. The image forming apparatus according to claim 2, comprising:

a correcting unit that corrects a shift between the images of different colors based on a detection result from the detecting unit, and the control unit controls the measuring unit to measure the reference time right after the correcting unit corrects the shift, and controls the position of forming the image based on the difference between the times.

4. The image forming apparatus according to claim 2, further comprising:

a correcting unit that calculates a correction value for correcting a shift between the images of different colors based on a detection result from the detecting unit, wherein the control unit calculates the reference time based on the time measured by the measuring unit and the correction value calculated by the correcting unit at the time of forming the pattern for each of the images, and controls the position of forming the image based on the difference between the times.

5. The image forming apparatus according to claim 2, wherein the measuring unit measures the time from a start of a control signal for controlling timing to start forming the image until a detection of the pattern for a specific color.

6. The image forming apparatus according to claim 5, wherein the measuring unit measures the time from a start of a control signal for controlling timing to start forming the image until a detection of the pattern for the specific color while the correcting unit corrects the shift of each of the images.

7. The image forming apparatus according to claim 5, wherein the specific color corresponds to a reference color used in correcting the shift.

8. The image forming apparatus according to claim 5, wherein the specific color is black.

9. The image forming apparatus according to claim 2, wherein the color image forming unit includes, for each of the colors, a latent-image forming unit that forms a latent image by irradiating an image carrier with a light modulated with image data;

a developing unit that develops the latent image; and a transferring unit that transfers the developed image on a recording sheet.

10. The image forming apparatus according to claim 2, wherein the color image forming unit further includes, for each of the colors, a latent-image forming unit that forms a latent image by irradiating an image carrier with a light modulated with image data;

a developing unit that develops the latent image;

a first transferring unit configured to rotate or move; and a second transferring unit that transfers the developed image onto the first transferring unit and to the recording sheet from the first transferring unit.

11. The image forming apparatus according to claim 1, further comprising:

a receiving unit that receives an instruction for measuring the reference time from an external device, wherein upon the receiving unit receiving the instruction, the measuring unit further measures the reference time.

12. An image forming method comprising:

forming a pattern for correcting a position shift of an image;

detecting the pattern;

measuring a first time from a start of a control signal for controlling timing to start forming the image until a detection of the pattern; and controlling position-shift corrections of a position of forming the image based on the time measured at the measuring and a reference time, wherein for a first position-shift correction, the first time measured is compared to the reference time and a position of forming the image is controlled based on a difference between the first time and the reference time, the reference time being the time at which the image position is aligned, and for subsequent position-shift corrections, the reference time is set as a time measured immediately after a previous position-shift correction, and the position of forming the image is controlled based on the difference between a first time corresponding to the previous position-shift correction and the reference time.

* * * * *